United States Patent [19]

Shama

[11] Patent Number: 4,848,770

[45] Date of Patent: Jul. 18, 1989

[54] THREE-PIECE SOLID GOLF BALL

[75] Inventor: Sami Shama, Hoffman Estates, Ill.

[73] Assignee: Wilson Sporting Goods Co., River Grove, Ill.

[21] Appl. No.: 921,153

[22] Filed: Oct. 20, 1986

[51] Int. Cl.[4] ..... A63B 37/06

[52] U.S. Cl. ..... 273/228; 273/230

[58] Field of Search ..... 273/218, 220, 217, 219, 273/221, 228, 229, 62

[56] References Cited

U.S. PATENT DOCUMENTS

| | | | |
|---|---|---|---|
| 698,515 | 4/1902 | Kempshall | 273/220 |
| 712,411 | 10/1902 | Richards | 273/220 |
| 3,438,933 | 4/1969 | Bartsch | 273/218 |
| 3,784,209 | 1/1974 | Berman | 273/218 |
| 4,065,537 | 12/1977 | Miller et al. | 273/218 |
| 4,431,193 | 2/1984 | Nesbitt | 273/218 |
| 4,483,537 | 11/1984 | Hanana et al. | 273/220 |
| 4,625,964 | 12/1986 | Yamada | 273/220 |
| 4,714,253 | 12/1987 | Nakahora et al. | 273/228 |

FOREIGN PATENT DOCUMENTS

| | | | |
|---|---|---|---|
| 1095615 | 12/1967 | United Kingdom | 273/220 |
| 2139101 | 11/1984 | United Kingdom | 273/220 |
| 2167309 | 5/1986 | United Kingdom | 273/220 |

*Primary Examiner*—George J. Mario

[57] ABSTRACT

A non-wound three piece golf ball which includes a spherical center, an intermediate mantle of elastomeric material covering the center and a molded cover forming the outside surface of the ball. The golf ball has the performance and feel of a three-piece ball. The golf ball has physical specifications which include diameter, 1.680–1.695 inches; hardness (Shore C) 60–95; and coefficient of restitution 0.695–0.810. The center comprises 90–100 parts by weight cis-1, 4 polybutadiene, 20–35 parts by weight cross linking agent, and 10–30 parts by weight filler. The mantle comprises from 90–100 parts by weight cis-1, 4 polybutadiene, 0–10 parts by weight natural rubber, 35–40 parts by weight cross-linking agent and 1–4 parts by weight filler.

7 Claims, 1 Drawing Sheet

THREE-PIECE SOLID GOLF BALL

BACKGROUND OF THE INVENTION

Conventional three piece golf ball construction includes a center, which is solid or liquid filled, a layer of rubber thread wound around the center, which is natural or synthetic rubber and a cover over the rubber thread which is usually an ionomer compound or balata. In the development of golf balls, one piece balls of solid materials have been produced to reduce the costs of rubber thread wound balls. Two piece balls comprising a solid core and an ionomeric cover are widely accepted due to their superior durability as compared to the conventional three piece ball.

U.S. Pat. Nos. 3,534,965 and 3,572,721 describe molded golf balls comprising blends of rubber and thermoplastic copolymers with one or more portions encased in a cover. The balls are only suitable for practice and for use on a driving range.

U.S. Pat. No. 3,348,933 discloses a molded golf ball produced from an elastomer such as a polymer, copolymer or terpolymer of butadiene, isoprene or chloroprene cross linked with a monomer having two readily polymerizing groups or sites such as butylene glycol dimethacrylate. There is a need for a molded, non-wound three piece golf ball that has the feel and "click" and flight characteristics of a rubber wound ball as well as the durability and cut resistance of the two piece ball.

SUMMARY OF THE INVENTION

This invention provides a multi-centered three piece golf ball with excellent performance characteristics, i.e., trajectory, driving distance; and the feel of a three piece ball as well as the durability of the two piece ball. It is substantially impervious to cracking caused by impact with a golf club. The golf ball comprises a center produced from highly filled crosslinked synthetic rubber or polymeric material centered within a mantle produced from substantially synthetic crosslinked unfilled rubber or polymeric material and a cover produced from ionomer compounds.

DESCRIPTION OF THE DRAWINGS

The invention will be explained in conjunction with illustrative embodiments shown in the accompanying drawing, in which.

DESCRIPTION OF THE SPECIFIC EMBODIMENTS

Figure 1:
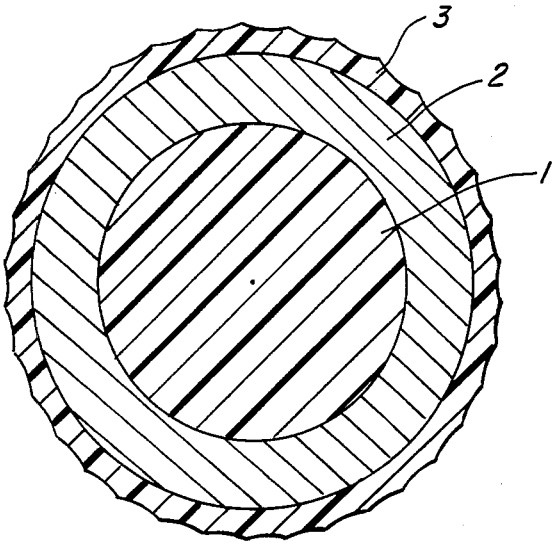
FIG. 1 illustrates a perspective view of one-half of a three piece golf ball showing the center, the mantle and cover.

According to the present invention there is provided a golf ball comprising a center, mantle and a cover that combines the feel and playability of a three piece ball with the durability of a two piece ball, thus bridging the gap between the two types of balls. The golf ball of the present invention has excellent hardness and coefficient of restitution characteristics to obtain the desired combination of properties.

The center comprises a highly filled cross-linked synthetic rubber or polymeric material, a cross-linking agent, a filler, a polymerization initiator and anti-oxidant. More specifically, the center comprises a cured spherical body, having highly filled, sulfur cured natural rubber compounds, highly filled thermoplastic rubbers such as Santoprene, manufactured by Monsanto Company, highly filled thermoplastic compounds such as glass filled polyethylene, polystyrene or polycarbonate or polybutadiene base compounds preferably cis-1,4 polybutadiene rubber as its principal component. Polybutadiene is well known and is made by polymerizing butadiene under such conditions that the resulting polymer has at least 90% of the butadiene content in the form of the cis-1,4, isomeric configuration. Generally, more than 97% of the butadiene units are combined in the cis-1,4, isomeric configuration. Any of the commercially available cis-1,4, polybutadiene rubbers having at least 90% cis-1,4, structure, and preferably having at least 97% cis-1,4, structure, can be used in the practice of this invention. With no intent to be limiting, the use of cis-1,4 polybutadiene in the center of the golf ball of the present invention will be described, for any of the aforementioned natural and synthetic rubbers are suitable for use therein.

In the description of the center and mantle of the golf ball of this invention, it is convenient to express the proportions of the other ingredients as parts by weight based on 100 parts by weight of the cis-1,4, polybutadiene. Cis-1,4, polybutadiene exhibits a higher coefficient of restitution than natural rubber or similar polymers suitable for use in this formation.

The crosslinking agent is a monomer which is capable of reacting with the active sites in the synthetic rubber causing polymerization. In order to serve as a crosslinking agent, the monomer generally must be in the form of a bi-functional compound, i.e., compounds having two readily polymerizing groups of sites. The term "monomer" as used herein is used in its broadest sense and is not restricted to monomeric units but includes partial polymers capable of further polymerization. Examples of these monomers which are referred to herein and in the claims as crosslinking monomers include: vinyl, allyl, methallyl, furfuryl, crotyl and cinnamyl esters of the following acids: oxalic, malonic, succinic, glutaric, adipic, pimelic, suberic, azelaic, sebacic, maleic, itaconic, citraconic, mesaconic, fumaric, aconitic, phthalic, isophthalic, terephthalic, naphthalene dicarboxylic, mellitic, pyromellitic, trisesic, acrylic, methacrylic, cinnamic, and crotonic. Also are polyamine amides and imides of the following acids: maleic, itaconic, acrcylic, methacrylic, crotonic, citraconic, aconitic and cinnamic, polyol esters and anhydrides of acrylic methacrylic, crotonic and cinnamic acids. Other materials include di- and triallyl cyanurate; di- and triallylmelamino; divinyl benzene, diallyl benzene; diallyl amine, allyl ether; allyl glycolates; di- tri and tetravinyl and allyl silanes. Still further suitable materials are low molecular weight reactive polymers such as polymers of butadiene, isoprene, chloroprene and epoxidized derivatives of these materials. The diacrylates and dimethacrylates, as for example butylene glycol dimethacrylate, have proved preferable though divinyl compounds, such as divinyl benzene have also proven highly suitable. However, preferably, the crosslinking monomers may be zinc mono-acrylate, zinc diacrylate, zinc dimethacrylate, zinc methacrylate, and blends thereof. Most preferably, zinc diacrylate is utilized. The monomer preferred for use in the present invention is zinc diacrylate.

A filler is required to provide the proper density to the finished ball so that it will have the desired weight and to provide the compression and cut resistance required for the ball. Most preferably, the filler material is in the form of zinc oxide. However, any of the known fillers commonly used in rubber and plastic compositions may be utilized in this invention.

The polymerization initiator may be any known or conventional initiator capable of producing the free radicals needed to start the polymerization reaction. Generally, these initiators contains O-O or N-N bonds such as peroxide persulfate, azo compounds, etc. Peroxides, such as dicumyl peroxide, are most conveniently used. Other curing agents known to the art to be effective sources of free radicals for polymerization reactions include other organic peroxides such as lauroyl peroxide, benzoyl peroxide, and t-butyl hydroperoxide, and other free radical sources such as azobis-isobutyronitrite, etc.

The mantle of the golf ball, which is the layer of the polymeric material encompassing the center comprises crosslinked unfilled synthetic rubber. The preferred synthetic crosslinked unfilled rubber, cis-1,4, polybutadiene, may be blended with small portions of natural rubber in the mantle. A crosslinking agent, filler, and polymerization initiator are also utilized in the mantle to provide the required hardness and cut resistance to the ball. The following table shows the broad and preferred ranges of ingredients for both the center and mantle of the golf ball of this invention:

TABLE 1

| | (Parts by Weight) | | | |
|---|---|---|---|---|
| | Center | | Mantle | |
| | (Broad Range) | (Preferred) | (Broad Range) | (Preferred) |
| Cis, 1,4 | 90 to 100 | 100 | 90 to 100 | 95 |
| Natural Rubber | — | — | 0 to 10 | 5 |
| Zinc Diacrylate | 20 to 35 | 21 | 35 to 40 | 38 |
| Zinc Oxide | 10 to 30 | 20 | 1 to 4 | 1 |
| Dicumyl Peroxide | 2 to 5 | 1.7 | 1 to 4 | 2 |
| Antioxidant | 1 to 3 | 0.5 | 1 to 3 | 0.5 |
| Barytes | 30 to 80 | 55 | — | — |

The amounts of the ingredients other than the synthetic or natural rubber can range widely in the formulation for this golf ball. Properties of the golf ball, such as compression, co-efficient of restitution, hardness, and cut resistance are affected by changes in the amounts of these components. The preferred formulation shown results in a golf ball with superior physical properties having excellent hardness, compression, co-efficient of restitution and distance when driven by a golf club.

The cover composition of the golf ball of this invention may be any conventional composition suitable for covering golf balls such as balata, or a Surlyn composition manufactured by E.I. Du Pont de Demours and Company, Wilmington, Del. Surlyn is a trademark for ionomer resins which comprise copolymers of olefins and unsaturated monocarboxylic acid salts. Additives such as antioxidats, stabilizers and coloring agents may be added. Ionomer resins are preferred for the cover composition of the present invention.

In making the three-piece golf ball according to the invention, the several components are uniformly mixed together in an internal mixer following a definite time, temperature, and order of addition schedule. Generally, all of the components are mixed at temperatures of 100 to 210 degrees F. in a conventional internal mixer. The mixing starts with the blend of components at room temperature and the temperature increases gradually as the mixing time increases. The uniform mixture then cools down to below 150 degrees F. The stock is then molded under conditions of temperature and pressure to effect the curing. The following Table 2 describes the procedure for mixing the ingredients of the center and mantle.

TABLE 2

| Mixing Procedure (Internal Mixer) | | | |
|---|---|---|---|
| Time (Min.) | Speed (RPM) | Center | Mantle |
| 0 | 75 | Introduce Rubber | Introduce Rubber |
| 1.5 | 75 | Add Zinc Oxide and Antioxidant | Add Zinc Oxide and Antioxidant |
| 3.0 | 50 | Add Zinc Diacrylate | Add Zinc Diacrylate |
| 4.0 | 50 | Add Barytes & Sweep Down | — |
| 4.5 | 50 | — | Sweep Down |
| 6.0 | 50 | Sweep Down and add Peroxide | Sweep Down Add Peroxide |
| 7.0 | Adjust | — | Sweep Down, dump at 210 Degrees F. |
| 7.5 | Adjust | Sweep Down & Dump at 210 Degrees F. | — |

The center is manufactured by injection molding of the mixed synthetic rubber stock by using conventional rubber injection molding techniques under the following conditions.

TABLE 3

| | |
|---|---|
| Nozzle Temperature | 200 degrees F. |
| Runner Temperature | 200 degrees F. |
| Mold Temperature | 350 degrees F. |
| Cure Time | 2.5 minutes |
| Total Cycle Time | 5.0 minutes |

The mantle is also manufactured by injection molding, although other molding techniques such as transfer molding are also acceptable. The center material may be completely cured or substantially cured when covered by the mantle. Upon covering by the mantle, the center will complete polymerization if it hasn't fully cured. There must be maximization of the bond between the center and the mantle so that the two components may act as a single unit. Failure to obtain the bond will render the ball unplayable due to energy losses at the interface between the center and the mantle. These losses could reduce the coefficient of restitution and decrease the ball's flight distance. The center is supported by a suitable means to allow for uniform material, comprising the mantle, to flow around it. Care must be taken to insure the placement of the core in the center of the mantle for it must be placed accurately to cause the geometric center and the center of gravity of the ball to coincide and to concentrate the weight in the center of the golf ball. Deviation from concentricity could lead to inaccuracies in flight and during putting of the ball, that could render the ball unplayable.

Injection molding of the mantle is performed under the following conditions:

TABLE 4

| | |
|---|---|
| Nozzle Temperature | 155 Degrees F. |
| Runner Temperature | 165 degrees F. |
| Mold Temperature | 340 degrees F. |
| Cure Time | 8.8 minutes |

TABLE 4-continued

| | |
|---|---|
| Total Cycle Time | 10.1 minutes |

The cover may be formedby a process of injection molding around the mantle or it may be molded, for example, by compression of two spherical half shells.

Referring now more particularly to FIG. 1 of the drawings, the three piece golf ball is shown comprising center 1 centrally in composite by mantle 2 enclosed by cover 3.

Figure 2:
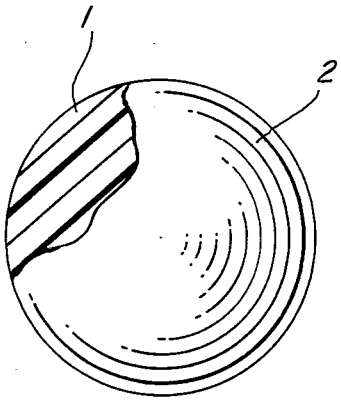
FIG. 2 illustrates the mantle encompassing the center of the three piece ball which together are identified as the core, with an area broken away to expose the center.

FIG. 2 shows the smooth surface of mantle 2 with a cut away view of center 1.

Physical properties of the components of the three piece golf ball according to the present invention are as follows:

TABLE 5

| Physical Properties: Center | Preferred Range | Broad Range |
|---|---|---|
| Diameter, Inches | 0.97 to 1.03 | 0.70 to 1.25 |
| Hardness, Shore C | 75 to 80 | 50 to 95 |
| Coefficient of Restitution | 0.710 to 0.725 | 0.695 to 0.760 |
| Specific Gravity | 1.438 to 1.453 | 1.300 to 1.500 |
| Compression (PGA) | 55 to 78 | 40 to 90 |

TABLE 6

| Physical Properties: Mantle | Preferred Range | Broad Range |
|---|---|---|
| Radial Thickness (in.) | 0.235 to 0.2675 | 0.1275 to 0.4750 |
| Hardness, Shore C | 79 to 85 | 50 to 95 |
| Coefficient of Restitution | 0.758 to 0.805 | 0.695 to 0.810 |
| Specific Gravity | 1.07 to 1.09 | 1.00 to 1.20 |
| Compression (PGA) | 70 to 82 | 40 to 90 |

TABLE 7

| Physical Properties: Core (Center & Mantle) | Preferred Range | Broad Range |
|---|---|---|
| Diameter, (in.) | 1.500 to 1.510 | 1.490 to 1.560 |
| Hardness, Shore C | 77 to 85 | 50 to 95 |
| Coefficient of Restitution | 0.746 to 0.794 | 0.695 to 0.810 |
| Specific Gravity | 1.188 to 1.205 | 1.150 to 1.250 |
| Compression (PGA) | 70 to 80 | 50 to 90 |

TABLE 8

| Physical Properties: Finished Ball (Surlyn Cover) | Preferred Range | Broad Range |
|---|---|---|
| Diameter, (in.) | 1.680 to 1.690 | 1.680 to 1.695 |
| Hardness, Shore C | 85 to 90 | 60 to 95 |
| Coefficient of Restitution | 0.744 to 0.781 | 0.695 to 0.810 |
| Compression (PGA) | 95 to 110 | 60 to 120 |
| Initial Velocity, fps | 249 to 250 | 248 to 255 |
| Spin Rate, driver (rpm) | 3100 to 3400 | 3000 to 3900 |
| Spin Rate, 8 iron (rpm) | 7200 to 7600 | 7000 to 8500 |
| Total Distance Driver @ 145 fps, yards | 235 to 264 | 230 to 265 |
| Trajectory: Apogee using Driver @ 145 fps (in deg.) | 10.4 to 10.6 | 10 to 11 |

As mentioned above, three piece golf balls of the present invention have superior hardness and impact properties which allow for a greater distance when hit by a golf club.

The coefficient of restitution is generally indicative of the resiliency of a ball, therefore indicative of the initial velocity of the ball when struck with a golf club. Both the center and mantle contribute to the coefficient of restitution of the golf ball. The coefficient of restitution is generally measured by propelling a finished ball or for the purposes of this invention, a center or a center covered by a mantle, against a hard surface at a fixed velocity. After the ball has rebounded from the surface its velocity is again measured. The ratio of the rebounded velocity over the initial velocity is the coefficient of restitution. In this invention the coefficient of restitution is maintained at the highest possible level by ensuring perfect encapsulation of the center by the mantle. This is accomplished in the cure cycle which allows the center material to crosslink with the mantle material during the molding process. Thus, the interface between the two components of the composite core is virtually eliminated and the two components behave as a single unit with minimum energy dissipation during impact. Separately, the diameter of the center may be from 0.70 inches to 1.25 inches. The radial thickness of the mantle may range from 0.1275 to 0.4750 inches. After curing, the diameter of the center and mantle may range from 1.490 to 1.560 inches.

The present invention is more specifically described and explained by the following comparative Examples. The formulations used in the preparation of the present invention are described in Table 1. The process for mixing the ingredients is described in Table 2.

EXAMPLE I

DISTANCE TESTING

Non-wound three piece golf balls were produced in accordance with the present invention as described herein. The golf balls of the present invention were compared with commercially available three piece and two piece balls. Thirty balls of each type were utilized in the test. The balls were hit with various clubs with a True Temper Mechanical Golfer. The balls were struck at various club velocities and at a launch angle of 9 degrees. To minimize the effects of changing wind and atmospheric conditions, one ball was hit followed by one control ball. The process was repeated until thirty balls of each type were hit.

The distance was measured and the average of thirty values for each type was calculated. Table A shows the results.

TABLE A

| | | | Carry Distance | | Total Distance | |
|---|---|---|---|---|---|---|
| Ball Type | Club Used | Clubhead Velocity | Current | Invention | Current | Invention |
| 2 pc | Driver | 150 fps | 244.5 yds | 245.9 | 253.1 | 253.7 |
| 2 pc | 2 Iron | 120 fps | 185.9 | 195.5 | 194.0 | 209.8 |
| 2 pc | 5 Iron | 115 fps | 154.0 | 161.8 | 160.2 | 169.9 |
| 2 pc | 9 Iron | 105 fps | 101.1 | 101.8 | 103.2 | 104.6 |
| 3 pc | Driver | 150 fps | 230.8 | 232.5 | 240.5 | 241.5 |
| 3 pc | Metal wood | 150 fps | 233.1 | 236.8 | 245.4 | 247.0 |

The ball of the present invention performed substantially better than the conventional two piece golf ball on the 2 and 5 irons and substantially better than the three piece ball on the metal wood and the driver. The ball of the present invention was equivalent the two piece ball on the driver test.

EXAMPLE II

PLAYTEST SUMMARY

Subjective play-tests were conducted with the three piece non-wound bale of the present invention.

Twenty-five players were selected. Eighteen regularly used two piece balls and seven regularly used three piece balls. The players ranged in age from 23 to 76 years. The handicaps ranged from zero to 22.

66.7% of the two piece ball players preferred the inventive ball to their ball, in distance accuracy and feel.

33.3% found the ball equal in playability to their current two piece ball.

0.0% found the ball inferior to their current two piece ball.

The three piece ball players also showed preference for the inventive ball.

57.1% preferred the feel, distance and accuracy of the invention to their current three piece ball.

14.3% found the invention equal to a three piece ball.

28.6% preferred their current three piece ball to the inventive ball.

EXAMPLE III

SPIN TESTING

The spinning of the ball relates to its ability to stop on or "bite" a green. The spin tests were measured by stop action photography using six balls of each of the present invention, a commercially available three piece ball identified as "A" and a commercially available two piece ball identified as "B". The balls were hit by a True Temper Mechanical Golfer. The values in Table B are average for each type of ball.

TABLE B

| | Spin Rate | | |
|---|---|---|---|
| Golf ball | Driver | 5-Iron | 9-Iron |
| A (3 pc) | 2720 | 5740 | 7300 |
| Inventive ball | 2470 | 4410 | 6300 |
| B (2 pc) | 2330 | 4210 | 6100 |

The results indicate the ball of the present invention has greater spin and, therefore, better green gripping ability than a two piece ball.

EXAMPLE IV

DURABILITY-CUT RESISTANCE

A True Temper Mechanical Golfer equipped with a sand wedge was utilized to hit six balls of various manufacturers and construction which are commercially available. The balls were hit off center to damage the cover. The damaged balls were graded on a scale of 1 to 10, with 1 being the least desirable, i.e., the cover splitting open and allowing the core to protrude through the cover, and 10 being the most durable, i.e., showing a slight scratch or mark but no damage.

TABLE C

| Ball | Cut Resistance | Standard Deviation |
|---|---|---|
| 2 pc | 9.0 | 0.0 |
| 2 pc | 8.5 | 0.6 |
| Inventive Ball | 8.0 | 0.9 |
| 3 pc | 6.8 | 0.7 |
| 2 pc | 6.8 | 0.4 |
| 2 pc | 6.7 | 0.5 |
| 3 pc | 6.3 | 0.5 |
| 3 pc | 5.6 | 0.9 |
| 3 pc | 5.3 | 0.8 |
| 3 pc | 5.0 | 0.9 |

The golf ball of the present invention exhibits excellent cut resistance.

EXAMPLE V

COEFFICIENT OF RESTITUTION

Golf balls were ejected from an air cannon into a steel plate at a velocity of 135 to 145 fps. The inbound velocity as well as the outbound velocity, after hitting the plate, were accurately recorded using electronic light gates. The ratio of the outbound velocity to the inbound velocity was recorded for 12 balls of each type. The average ratio which is the coefficient of restitution, and the standard deviation were calculated. Both two piece and three piece commercially available balls were compared with the inventive ball.

TABLE D

| Ball | C.O.R. | Standard Deviation |
|---|---|---|
| 3 pc | 0.800 | 0.002 |
| Inventive ball | 0.766 | 0.009 |
| 2 pc | 0.754 | 0.008 |

The golf ball of the present invention has excellent resiliency, indicating a high velocity of the ball when struck with a golf club.

While there has been described what is at present considered to be a preferred embodiment of this invention, it will be obvious to those skilled in the art that various changes and modifications may be made without departing from the invention, and it is therefore, aimed to cover all such changes and modifications as full within the spirit and scope of the invention.

What is claimed is:

1. A three piece non-wound golf ball having improved performance characteristics comprising a center, mantle and cover, wherein said center comprises 90–100 parts by weight cis-1,4 polybutadiene, 20–35 parts by weight cross-linking agent, and 10–30 parts by weight filler; said mantle comprises from 90–100 parts by weight cis-1,4 polybutadiene, 0–10 parts by weight natural rubber, 35–40 parts by weight cross-linking agent and 1–4 parts by weight filler said ball having the following physical specifications:

Diameter Inches, 1.680–1.695
Hardness (Shore C), 60–95
Coefficient of Restitution, 0.695–0.810
Compression (PGA) 60–120.

2. The three piece golf ball of claim 1 wherein the mantle and the center are concentric.

3. The three piece golf ball of claim 1 wherein the cross-linking agent is zinc diacrylate.

4. The three piece golf ball of claim 1 wherein the filler is zinc oxide.

5. The three piece golf ball of claim 1 wherein the center has the following physical specifications:

Diameter, Inches, 0.70 to 1.25
Hardness, Shore C, 50 to 95
Coefficient of Restitution, 0.695 to 0.760
Specific Gravity, 1.300 to 1.500
Compression (PGA), 40 to 90.

6. The three piece golf ball of claim 1 wherein the mantle has the following physical specifications:

Radial Thickness (in.) 0.1275 to 0.4750
Hardness, Shore C 50 to 85
Coefficient of Restitution 0.695 to 0.810
Specific Gravity 1.00 to 1.20
Compression (PGA) 40 to 90.

7. The three piece golf ball of claim 1 wherein the center and mantle have the following physical specifications:

Diameter, Inches 1.490 to 1.560
Hardness, Shore C 50 to 95
Coefficient of Restitution 0.695 to 0.810
Specific Gravity 1.150 to 1.250
Compression (PGA) 50 to 90.

* * * * *